United States Patent [19]

Nilssen

[11] Patent Number: 4,928,039

[45] Date of Patent: May 22, 1990

[54] ELECTRONIC BALLAST WITH LAMP PRE-CONDITIONING

[76] Inventor: Ole K. Nilssen, Caesar Dr. Rte. 5, Barrington, Ill. 60010

[21] Appl. No.: 377,767

[22] Filed: Jul. 10, 1989

Related U.S. Application Data

[63] Continuation of Ser. No. 678,021, Dec. 4, 1984, abandoned.

[51] Int. Cl.[5] ..... H05B 37/02

[52] U.S. Cl. ..... 315/209 R; 315/106; 315/DIG. 2; 315/DIG. 7

[58] Field of Search ..... 331/113 A; 315/102, 315/105, 106, 209 R, DIG. 2, DIG. 7; 338/20; 363/50, 172, 159

[56] References Cited

U.S. PATENT DOCUMENTS

| | | | |
|---|---|---|---|
| 4,029,993 | 6/1977 | Alley et al. | 315/209 R |
| 4,045,711 | 8/1977 | Pitel | 315/209 R |
| 4,127,798 | 11/1978 | Anderson | 315/209 R |
| 4,184,128 | 1/1980 | Nilssen | 331/113 A |
| 4,188,661 | 2/1980 | Bower et al. | 331/113 A |
| 4,288,831 | 9/1981 | Dolikian | 363/50 |
| 4,438,372 | 3/1984 | Zuchtriegel | 315/283 |

*Primary Examiner*—Robert J. Pascal

[57] ABSTRACT

In a power-line-operated inverter-type fluorescent lamp ballast with a high-Q parallel-loaded resonant L-C circuit series-connected across the inverter's output, subject invention provides for means to prevent the destructive overload that may occur during the lamp starting period or if the lamp is removed or somehow fails to operate. In this ballast, the unfiltered pulsed DC output of a full-wave power-line-supplied rectifier means is applied to a pair of inverters: an auxiliary inverter for pre-conditioning the fluorescent lamp, and a main inverter for powering the lamp. The auxiliary inverter starts operating immediately upon application of power from the power line, and therefore immediately starts the process of pre-conditioning. The main inverter, however, is not started until after the lamp has completed its conditioning, at which time the lamp will adequately load the series-resonant L-C circuit and thereby prevent destructive overload. If at any time the main inverter is operating, but if the lamp is removed or otherwise fails to adequately load the L-C circuit, the main inverter is immediately disabled for a pre-determined period.

22 Claims, 1 Drawing Sheet

ELECTRONIC BALLAST WITH LAMP PRE-CONDITIONING

This is a continuation of Ser. No. 678,021 filed Dec. 4, 1984 now abandoned.

BACKGROUND OF THE INVENTION

1. Field of Invention

The present invention relates to power-line-operated electronic inverter-type fluorescent lamp ballasts.

2. Background Considerations

In an ordinary non-instant-start-type fluorescent lamp, a cathode must be heated to incandescence before electron emission starts and the lamp becomes conductive; and this heating process is apt to require from one to two seconds. Thus, aside from the relatively modest amount of power needed to accomplish the conditioning, and provided that the lamp is not driven into a destructive instant-start mode, a fluorescent lamp is substantially a non-conducting load until its cathode has reached incandescence.

In many applications of electronic inverter-type ballasts for fluorescent lamps, it is often desirable to power the lamp by way of having it parallel-connected across the tank capacitor of a high-Q resonant L-C circuit—with this L-C circuit itself being series-connected directly across the inverter's output.

However, when such a high-Q series-resonant L-C circuit is not loaded, it acts substantially as a short circuit; which, during even a brief period (such as during the one or two seconds it takes for the lamp to become effectively conductive), is apt to cause destructive overload of the inverter and/or the L-C circuit itself.

One way of preventing such destructive overload is that of connecting in parallel with the lamp a voltage-limiting means (like a Varistor) characterized by: (i) not conducting at the highest magnitude of voltage normally present across the lamp when it is conducting; and (ii) conducting heavily at a voltage of somewhat higher magnitude than that.

However, in many applications, due to the significant amount of energy that must be absorbed by this voltage limiting means, even if the required conditioning period is only a couple of seconds in duration, the effective cost associated with such a method of preventing destructive overload of inverter and/or L-C circuit is very high.

Also, the potential inefficiency involved—as for instance in a situation where the lamp fails to ignite or is simply removed from the L-C circuit—can represent a major obstacle to designing a fully functional product.

SUMMARY OF THE INVENTION

Objects of the Invention

An object of the present invention is that of providing a basis for designing a power-line-operated, high-power-factor, high-efficiency, cost-effective, inverter-type fluorescent lamp ballast.

Another object is that of providing an inverter-type ballast operative to safely power a fluorescent lamp that is parallel-connected with a series-driven high-Q series-resonant L-C circuit.

These as well as other important objects and advantages of the present invention will become apparent from the following description.

Brief Description

In its preferred embodiment, subject invention relates to a power-line-operated fluorescent lamp ballast that, in effect, is an electronic inverter-type power supply operable to series-drive a high-Q parallel-loaded resonant L-C circuit, where the parallel-connected load is a fluorescent lamp of such a nature as to have to be conditioned for a period of about two seconds before becoming fully conductive.

In this power supply, the unfiltered pulsed DC output of a full-wave rectifier is applied to a pair of inverters: an auxiliary inverter for pre-conditioning the lamp, and a main inverter for powering the lamp. The auxiliary inverter starts operating immediately upon application of power from the power line; and its output is used for pre-conditioning the lamp. The main inverter is only started after the pre-conditioning is completed.

Both inverters are of the type that must be triggered into oscillation; and, since the pulsed DC supply voltage falls to zero magnitude once every half-cycle of the 60 Hz power line voltage, and since the inverters then cease oscillating, it is necessary for each inverter to be re-triggered for each half-cycle of 60 Hz voltage for as long as power output is desired from it.

In case the lamp is removed or otherwise ceases to conduct, the re-triggering function for the main inverter is immediately blocked for a few seconds, thereby disabling the main inverter and preventing it from destructive overload. After a few seconds, the main inverter is again triggered; but, if the overload condition still exists, the re-triggering mechanism will again be immediately blocked for a few seconds.

DESCRIPTION OF THE PREFERRED EMBODIMENT

Details of Construction

Figure 1:
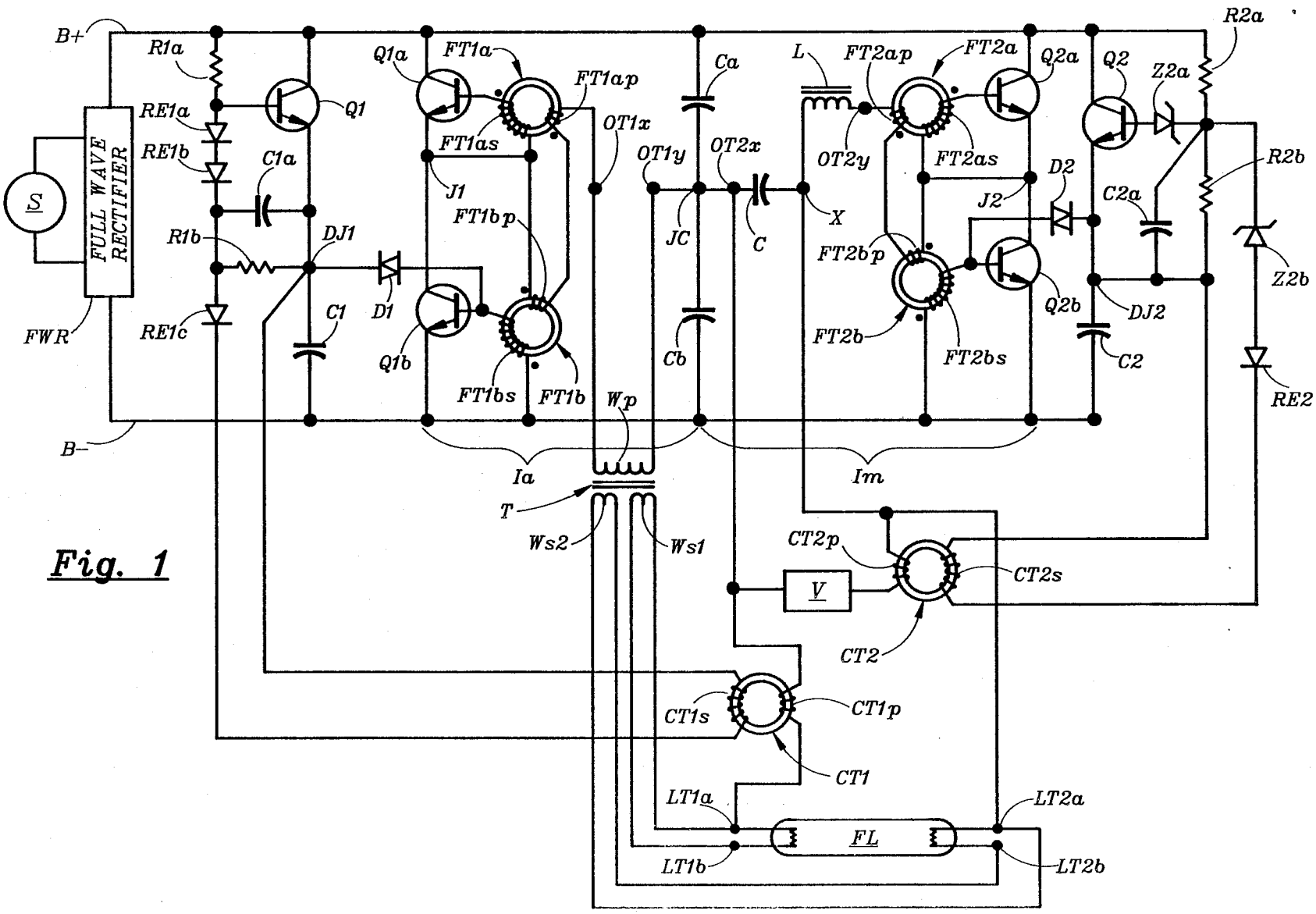
FIG. 1 schematically illustrates the preferred embodiment of the invention.

FIG. 1 shows an AC voltage source S, which in reality is an ordinary 120Volt/60Hz electric utility power line.

Connected to S is a full-wave rectifier FWR that rectifies the AC voltage from S to provide an unfiltered DC voltage between a positive power bus B+ and a negative power bus B−.

A first pair of transistors Q1*a* and Q1*b* are connected in series between the B+ bus and the B− bus in such a way that the collector of Q1*a* is connected to the B+ bus, the emitter of Q1*a* is connected with the collector of Q1*b* at a junction J1, and the emitter of Q1*b* is connected with the B− bus.

A second pair of transistors Q2*a* and Q2*b* are connected in series between the B+ bus and the B− bus in such a way that the collector of Q2*a* is connected to the B+ bus, the emitter of Q2*a* is connected with the collector of Q2*b* at a junction J2, and the emitter of Q2*b* is connected with the B− bus.

Primary winding FT1*ap* of saturable feedback transformer FT1*a* and primary winding FT1*bp* of saturable feedback transformer FT1*b* are connected in series between junction J1 and output terminal OT1*x*. Another output terminal OT1*y* is connected with junction JC between capacitors Ca and Cb; which capacitors are connected in series between the B+ bus and the B− bus.

Primary winding FT2*ap* of saturable feedback transformer FT2*a* and primary winding FT2*bp* of saturable feedback transformer FT2*b* are connected in series between junction J2 and output terminal OT2*y*. Another output terminal OT2*x* is connected with junction JC.

Secondary winding FT1*as* of feedback transformer FT1*a* is connected between the base and the emitter of transistor Q1*a;* and secondary winding FT1*bs* of feedback transformer FT1*b* is connected between the base and the emitter of transistor Q1*b*.

Secondary winding FT2*as* of feedback transformer FT2*a* is connected between the base and the emitter of transistor Q2*a;* and secondary winding FT2*bs* of feedback transformer FT2*b* is connected between the base and the emitter of transistor Q2*b*.

A capacitor C is connected between output terminal OT2*x* and a point X; and an inductor L is connected between point X and output terminal OT2*y*.

Primary winding Wp of transformer T is connected with inverter output terminals OT1*x* and OT1*y*. Secondary winding Ws1 of transformer T is connected with lamp terminals LT1*a* and LT1*b* is connected with lamp terminals LT2*a* and LT2*b* of FL.

Lamp terminal LT2*a* is connected with point X, and lamp terminal LT1*a* is connected with output terminal OT2*x* by way of primary winding CT1*p* of control transformer CT1.

A Varistor V is connected between point X and output terminal OT2*x* by way of primary winding CT2*p* of control transformer CT2.

Secondary winding CT1*s* of control transformer CT1 is connected between a junction DJ1 and the cathode of a rectifier RE1*c*. An auxiliary transistor Q1 is connected with its collector to the B+ bus and with its emitter to junction DJ1. A capacitor C1 is connected between junction DJ1 and the B− bus; and a Diac D1 is connected between junction DJ1 and the base of transistor Q1*b*. A resistor R1*b* and a capacitor C1*a* are connected in parallel between junction DJ1 and the anode of rectifier RE1*c*.

A resistor R1*a* is connected between the B+ bus and the base of transistor Q1; and two rectifiers RE1*a* and RE1*b* are connected in series between the base of transistor Q1 and the anode of RE1*c*—with the anode of RE1*a* being connected with the base of transistor Q1, and with the anode of RE1*b* being connected with the cathode of RE1*a*.

Secondary winding CT2*s* of control transformer CT2 is connected between a junction DJ2 and the cathode of a rectifier RE2. An auxiliary transistor Q2 is connected with its collector to the B+ bus and with its emitter to junction DJ2. A capacitor C2 is connected between junction DJ2 and the B− bus; and a Diac D2 is connected between junction DJ2 and the base of transistor Q2*b*. A resistor R2*b* and a capacitor C2*a* are connected in parallel between junction DJ2 and the cathode of a Zener diode Z2*a*, whose anode is connected with the base of auxiliary transistor Q2.

A resistor R2*a* is connected between the B+ bus and the cathode of Zener diode Z2*a*. A Zener diode Z2*b* is connected with its cathode to the cathode of Zener diode Z2*a* and with its anode to the anode of rectifier RE2.

The assembly consisting of transistors Q1*a* and Q1*b*, feedback transformers FT1*a* and FT1*b*, and output terminals OT1*x* and OT1*y* is referred to as auxiliary inverter Ia. The assembly consisting of transistors Q2*a* and Q2*b*, feedback transformers FT2*a* and FT2*b*, and output terminals OT2*x* and OT2*y* is referred to as main inverter Im.

Description of Operation

The operation of the ballast arrangement of FIG. 1 may be further explained as follows.

FIG. 1 shows two half-bridge inverters: an auxiliary inverter Ia consisting of transistors Q1*a* and Q1*b* with their respective saturable positive feedback transformers FT1*a* and FT1*b;* and a main inverter Im consisting of transistors Q2*a* and Q2*b* with their respective saturable positive feedback transformers FT2*a* and FT2*b*.

Both inverters are capable of self-oscillation by way of positive feedback. When they do oscillate, the frequency of oscillation is about 30 kHz. For further explanation of the operation of this type of inverter, reference is made to U.S. Pat. No. 4,184,128, and particularly to FIG. 8 thereof.

Each of these inverters has to be triggered into oscillation; but they will only oscillate as long as the magnitude of the voltage between the B− bus and the B+ bus exceeds about 20 Volt. Thus, if one of the inverters is triggered into oscillation at the beginning of one of the sinusoidally-shaped DC voltage pulses existing between the B− bus and the B+ bus (as resulting from the unfiltered full-wave rectification of the voltage from the ordinary 120Volt/60Hz power line), that inverter will cease oscillating at the end of that DC voltage pulse. Thus, to keep either one of the inverters operating on a continuous basis, it is necessary that it be re-triggered at a rate of 120 times per second—i.e., once in the beginning of each half-cycle of the 120Volt/60Hz power line voltage.

Both the half-bridge inverters use capacitors Ca and Cb to provide for an effective center-tap between the B− bus and the B+ bus—this center-tap being junction JC.

When power line voltage is initially applied to the arrangement of FIG. 1, transistor Q1 will immediately be biased into a conductive state; which implies that capacitor C1 will immediately start to receive charge from the B+ bus. As soon as C1 has reached a voltage high enough to cause breakdown of Diac D1, a trigger pulse will be applied to the base of transistor Q1*b*, thereby initiating auxiliary inverter Ia into self-oscillation.

The time required for capacitor C1 to be charged to Diac breakdown voltage is arranged to be but a small fraction of the length of a half-cycle of the 60 Hz power line voltage; which implies that the auxiliary inverter Ia will be triggered into oscillation at the beginning of each of the 120 Hz DC pulses provided between the B− bus and the B+ bus.

In other words, when it is being continuously triggered, the output from auxiliary inverter Ia will be a relatively high-frequency (30 kHz) squarewave AC voltage 100% amplitude-modulated at a frequency of 120 Hz.

By way of transformer T, the output from auxiliary inverter Ia is applied to the cathodes of fluorescent lamp FL, thereby conditioning this lamp and making it ready to conduct. For a typical fluorescent lamp, this conditioning takes from 1.0 to 1.5 second, after which time the lamp cathodes have reached incandescence and are capable of adequate electron emission.

And, after this initial conditioning period of at least 1.5 second, main inverter Im is started, thereby providing main power to the fluorescent lamp only after it has become completely thermionic and ready to conduct.

This delayed action on behalf of the main inverter is achieved by providing for a delay in making transistor Q2 conductive; which delay is due to the time it takes for capacitor C2*a* to charge to a voltage high enough to cause current to flow into the base of Q2. After this sufficiently high voltage has been reached, however, the time to charge C2 to the point of breaking down Diac D2 is only a small fraction of the length of a half-cycle of the 120Volt/60Hz power line voltage—just as in the case of capacitor C1 and Diac D1.

In other words, when starting from a discharged state, it takes some 1.5 to 2.0 seconds before transistor Q2 reaches the point of being conductive; but once that point is reached, its conductivity is such as to cause capacitor C2 to be charged up with a time-constant of about one millisecond.

Under normal circumstances, as soon as main inverter Im starts to oscillate, the fluorescent lamp instantly ignites (although not in normal instant-start fashion-)—having by that time been fully conditioned to conduct.

The resulting lamp current, flowing through the primary winding CT1*p* of control transformer CT1, now provides for a current to flow from the secondary winding CT1*s* of CT1; which current, for as long as it flows, biases transistor Q1 into a non-conductive state, thereby preventing auxiliary inverter Ia from receiving trigger pulses. Thus, as soon as lamp current starts to flow, the auxiliary inverter ceases to operate, thereby ceasing to provide cathode heating power.

Although not necessary to the basic operation of the ballast, it may never-the-less in some situations be advantageous to remove the conditioning voltage after the initial conditioning has been accomplished.

In particular, it may be advantageous for energy-efficiency reasons to remove the cathode heating power after the lamp has ignited.

Varistor V is chosen such that it will limit the voltage developing across tank capacitor C to a magnitude that is suitable for proper lamp ignition; which voltage might be of magnitude about twice that of the lamp's normal operating voltage.

If for some reason the fluorescent lamp should not ignite, the magnitude of the voltage developing across capacitor C (as resulting from Q-multiplication) would be limited by the voltage-clamping characteristics of Varistor V. Consequently, if the lamp should fail to ignite, current would flow through V and thereby through primary winding CT2*p* of control transformer CT2. This current would, within about one millisecond, charge capacitor C2*a* to a negative voltage; the effect of which would be that of removing the base current from transistor Q2, thereby rendering it non-conductive. With transistor Q2 in a nonconductive state, capacitor C2 does not get charged, and main inverter Im therefore ceases to operate because it does not receive triggering pulses. Of course, with the main inverter in a non-operating state, the current through the Varistor ceases to flow. However, it takes about five seconds for the negative voltage placed on C2*a* (as a result of the Varistor current) to be neutralized by current flowing from the B+ bus through resistor R2*a*. Thereafter, the main inverter again starts receiving its trigger pulses. However, if the lamp still fails to ignite, the same cycle will be repeated.

In other words, each time current flows through the Varistor for but a very brief period, main inverter Im is rendered inoperative for a period of about five seconds.

Otherwise, the following points should be noted.

(a) To prevent redundant triggering of the auxiliary inverter, a diode may be placed between junctions DJ1 and J1 —with its cathode connected with J1. Similarly, to prevent redundant triggering of the main inverter, a diode may be placed between junctions DJ2 and J2—with its cathode connected with J2.

(b) In some situations, with some fluorescent lamps, it may be necessary to permit current to flow through the Varistor for a very brief period without immediately causing shut-down of the main inverter. To achieve this effect, a delay means can readily be provided by way of well known art.

(c) As long as power is flowing through the Varistor, the rate of power dissipation in the Varistor is very large: about twice as large as the normal full power applied to the lamp when it is operating. With this full power being typically on the order of 80 Watt for a pair of F40/T12 fluorescent lamps (which is the most commonly occurring fluorescent lamp load), the implication is that the Varistor has to be able to handle a dissipation of about 160 Watt—at least for a short period. While this level of dissipation can reasonably be handled by an ordinary Varistor for perhaps as long as a few hundred milli-seconds—provided the average Varistor dissipation does not exceed about 1 Watt—it is quite beyond the capability of an ordinary Varistor to handle 160 Watt for as long as 2 seconds, which would result in an accumulated energy dissipation of 320 Joule.

(d) In fact, if the Varistor is called on to provide voltage limitation every five seconds or so, which is indeed the case in the instant embodiment, then it is unreasonable to subject it to more than about 5 Joule for each such instance of voltage limitation. At a power level of 160 Watt, 5 Joule of energy is put into the Varistor in a matter of about 30 milli-seconds.

(e) While the main inverter may be able to handle an overload of about 100% for a period of 30 milli-seconds, it is far less likely to do so for as long as 2 seconds. However, without the Varistor to provide voltage limitation, the power drawn by the L-C circuit, if for some reason the lamp failed to conduct, would cause far more than 100% overload. Depending on the Q of the L-C circuit, the power drawn from the inverter by an unloaded series-resonant L-C circuit could readily represent an overload of 500 to 1000%.

(f) When conducting, a fluorescent lamp constitutes a load of relatively constant-magnitude voltage. When such a constant-voltage load is parallel-connected with a high-Q series-driven resonant L-C circuit, the magnitude of the current drawn by the load is substantially proportional to the magnitude of the AC voltage driving the L-C circuit. As a consequence, the instantaneous magnitude of the current drawn by the inverter from the power line is substantially proportional to the instantaneous magnitude of the power line voltage; which implies that the ballast of FIG. 1 draws power from the power line with a good power factor.

(g) Because the main inverter is disabled within a few milliseconds if the fluorescent lamp is removed from the circuit, the ballast of FIG. 1, if used in an ordinary lighting fixture, exhibits a high degree of safety from electric shock hazard.

(h) Capacitors Ca and Cb of FIG. 1 are sized such as not to store a significant amount of energy in comparison to the amount of energy drawn by the ballast circuit during one complete half-cycle of the 120Volt/60Hz power line voltage, while at the same time to store an amount of energy that is several times as large as the amount of energy used by the inverters during one half-cycle of the 30 kHz inverter output voltage.

(i) In the ballast circuit of FIG. 1, conditioning power is removed from the fluorescent lamp as soon as lamp current flows. While this feature may be distinctly advantageous in some situations; in other situations, such as when it is necessary to operate the fluorescent lamp at a substantially below-normal output level, it is not desirable to remove the conditioning power.

To keep conditioning power flowing, it is only necessary to remove control transformer CT1, and to replace its primary winding CT1*p* with a short circuit and its secondary winding CT1*s* with an open circuit.

(j) The power supplied to the fluorescent lamp depends on the timing or phasing of the trigger pulses provided to main inverter Im. In turn, the timing of these trigger pulses depend on the delay associated with the process of charging capacitor C2 to a voltage high enough to cause breakdown of Diac D2. The length of this delay can be adjusted over a wide range by adjusting the resistance value of R2*a* (and/or by changing the capacitance of C2*a* and/or the threshold voltage on Zener diode Z2*a*).

Hence, by making R2*a* an adjustable resistor, the amount of light provided by the fluorescent lamp may be adjusted over a wide range. However, when such adjustability is desired, it is necessary that lamp conditioning power (i.e., cathode heating power) be provided on a continuous basis.

It is noted that the threshold voltage of Zener diode Z2*b* should be slightly higher than that of Z2*a*.

It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A fluorescent lamp and ballasting arrangement comprising:

a source operable to provide an AC voltage at an output;

an L-C circuit resonant at or near the frequency of this AC voltage and effectively series-connected across said output;

a fluorescent lamp that requires pre-conditioning before being operable to effectively absorb power, said lamp having a power input connected with said L-C circuit, as well as an auxiliary input by which to effect said pre-conditioning;

conditioner means connected with this auxiliary input and operable to effect said pre-conditioning; and means to prevent the source from providing the AC voltage at said output, and thereby across the L-C circuit, until after the pre-conditioning has been effected.

2. The ballast of claim 1 wherein the source comprises a frequency converting means connected with an ordinary electric power line.

3. The ballast of claim 2 wherein the frequency of said AC voltage is substantially higher than that of the voltage normally present on said power line.

4. The ballast of claim 1 comprising means operative to remove said AC voltage in the event that the lamp ceases to effectively absorb power.

5. The ballast of claim 1 wherein said AC voltage is of a relatively high frequency and substantially 100% amplitude-modulated at a relatively low frequency.

6. The ballast of claim 1 wherein said auxiliary input requires a substantive amount of power to effect said conditioning, and where said conditioner means is operable to supply this substantive amount of power.

7. The ballast of claim 6 wherein the lamp does not require conditioning after it has started to effectively absorb power by way of said power input, and wherein said conditioner means ceases to supply power to the auxiliary input as soon as the lamp has started to effectively absorb power.

8. A ballasting arrangement for a fluorescent lamp, said lamp having main input terminals adapted to receive lamp operating voltage and auxiliary input terminals adapted to receive lamp conditioning power, said lamp conditioning power being operable to permit the lamp to effectively absorb operating power from said operating voltage, said arrangement comprising:

supply operable to provide lamp conditioning power;

source operable in response to trigger pulses to provide, for each trigger pulse, lamp operating voltage for a brief period; and trigger means operative controllably to provide said trigger pulses, thereby controllably providing brief periods of lamp operating voltage.

9. The arrangement of claim 8 wherein, within each of said brief periods, the lamp operating voltage exhibits a plurality of cycles of alternating polarity.

10. The arrangement of claim 8 wherein said trigger means is operable to provide said trigger pulses on a periodic basis, thereby to provide brief periods of lamp operating voltage on a correspondingly periodic basis.

11. The arrangement of claim 10 wherein said brief periods of lamp operating voltage occur periodically at a relatively low frequency while the lamp operating voltage is an AC voltage of relatively high frequency.

12. The arrangement of claim 8 wherein said source comprises frequency converter means connected with an ordinary electric power line and wherein the lamp operating voltage is an AC voltage of frequency substantially higher than the frequency of the voltage on said power line.

13. The arrangement of claim 8 comprising means whereby, if the lamp fails to absorb operating power from said lamp operating voltage, said trigger means is prevented from providing said trigger pulses.

14. An arrangement to power a fluorescent lamp, comprising:

source adapted in response to trigger pulses to provide, for each trigger pulse, power to the lamp for a brief period; and means operative controllably and periodically to provide said trigger pulses, thereby controllably to provide periodic brief periods of lamp operating power.

15. The arrangement of claim 14 wherein said source comprises frequency conversion means connected with an ordinary electric power line and operable to provide said power by way of an AC voltage of frequency substantially higher than the frequency of the voltage on said power line.

16. The arrangement of claim 14 wherein said power is provided to the lamp by way of a voltage having a plurality of polarity reversals during said brief period.

17. The arrangement of claim 14 wherein, if said power fails to exceed a pre-determined level, said means is prevented from providing said trigger pulses.

18. The arrangement of claim 14 wherein said source is connected with an ordinary electric power line and wherein said trigger pulses are provided at a frequency equal to twice that of the frequency of the voltage on said power line.

19. An arrangement comprising:

rectifier means connected with an ordinary electric utility power line and operable to provide a DC voltage at a DC output;

inverter means connected with said DC output and controllably operable to provide an AC voltage at an AC output;

an L-C circuit resonant at or near the frequency of this AC voltage and effectively series-connected across this AC output, said L-C circuit representing a potentially destructive short circuit to said AC output except if being effectively loaded;

fluorescent lamp operable to effectively load said L-C circuit, but only after having received conditioning by way of an auxiliary input said conditioning requiring a period of time before becoming effective;

a conditioner means connected with this auxiliary input and operable to accomplish said conditioning; and means to prevent the inverter from providing the AC voltage until said conditioning has become effective.

20. An arrangement comprising:

a gas discharge lamp having: (i) a pair of main input terminals adapted to receive lamp operating current, and (ii) a set of auxiliary input terminals adapted to receive lamp conditioning current; the lamp requiring conditioning current prior to being properly operable to receive operating current;

first means connected with the auxiliary input terminals and operative to provide lamp conditioning current; and second means connected with the main input terminals and operative to provide lamp operating current, but only after conditioning current has been provided for a brief period; there being substantially no current flowing between the main input terminals until after the conditioning current has been provided for said brief period.

21. An arrangement comprising:

a gas discharge lamp having: (i) a pair of main input terminals conditionally adapted to draw a lamp operating current from a lamp operating voltage, and (ii) a set of auxiliary input terminals adapted to receive lamp conditioning power; the lamp requiring conditioning power prior to being properly adapted to draw the lamp operating current;

first means connected with the auxiliary input terminals and operative to provide lamp conditioning power; and second means connected with the main input terminals and operative to provide the lamp operating voltage, but only after conditioning power has been provided for a given brief period of time; there being substantially no current flowing between the main input terminals until after the conditioning current has been provided for said brief period of time.

22. An arrangement comprising:

a set of auxiliary terminals;

a pair of main terminals;

a gas discharge lamp connected with the auxiliary and main terminals; the lamp being operative to draw conditioning power from the auxiliary terminals and operating power from the main terminals;

first supply means connected with the auxiliary terminals and operative to supply conditioning power thereto; and second supply means connected with the main terminals and operative to supply operating power thereto, but only after conditioning power has been provided to the auxiliary terminals for a brief period of time; there being substantially no current flowing between the main terminals until after the conditioning power has been supplied for said brief period of time.

* * * * *